United States Patent [19]

Sheck et al.

[11] 4,268,184

[45] May 19, 1981

[54] TWIN ROLLER PAINT APPLICATOR

[76] Inventors: Wah Sheck, 18304 Wachs Ter., Olney, Md. 20832; Al Lukevics, 7814 Baxter Ct., Annandale, Va. 22003

[21] Appl. No.: 46,671

[22] Filed: Jun. 8, 1979

[51] Int. Cl.[3] ..... B43M 11/02

[52] U.S. Cl. ..... 401/218; 401/208

[58] Field of Search ..... 401/15, 208, 218

[56] References Cited

U.S. PATENT DOCUMENTS

| | | | |
|---|---|---|---|
| 2,536,291 | 1/1951 | Kaitul | 401/218 |
| 2,871,500 | 2/1959 | Hunn et al. | 401/218 X |
| 3,128,494 | 4/1964 | Hohmann | 401/218 |
| 3,134,327 | 5/1964 | Sebanc | 401/218 X |
| 3,212,121 | 10/1965 | Munn | 401/218 |
| 3,263,263 | 8/1966 | Munn | 401/218 |

*Primary Examiner*—Edward M. Coven

*Attorney, Agent, or Firm*—Birch, Stewart, Kolasch & Birch

[57] ABSTRACT

A hand propelled coating device includes a coating product tray reservoir, a feed roller engaging an applicator roller rotatable by frictional drive imparted thereto when the applicator roller is rolled over a surface being coated, and an additional drive wheel with a traction band that is outboard and offset from the tray reservoir and the applicator roller as it coats a desired surface. The additional drive wheel also includes a quick-disconnect arrangement from the driver applicator roller shaft to avoid any wheel surface contact when desired, whereby no wheel marks on the finished surface will be made, it being important to have the additional traction wheel rim out of surface area engagement after the surface is covered with a finished coating.

11 Claims, 29 Drawing Figures

TWIN ROLLER PAINT APPLICATOR

BACKGROUND OF THE INVENTION

1. Field of the Invention

The present invention relates to a fountain type coating device wherein a reservoir tray supports a surface applicator roller that frictionally rotates as it is manually pushed against the surface and a fountain feeder roller mounted in the tray below, wherein the applicator roller engages and drives the fountain feeder roller to supply coating material to the surface of the applicator roller. More specifically, this invention relates to an additional drive means for the applicator and feeder rollers to provide a non-slip drive for said rollers.

2. Description of the Prior Art

Heretofore, prior art devices included manual fountain coating devices, wherein the coating composition such as paint of suitable viscosity is applied to the surface to be coated by the applicator roller as it drives itself by bearing pressure against the surface which causes the roller to turn as it is manually manipulated over the surface. For example, the following patents will exemplify the prior art:

| | | |
|---|---|---|
| 489,828 | W. Peterson | 1/10/1893 |
| 979,300 | W. W. Hill | 12/20/10 |
| 2,424,323 | J. Millholland | 7/22/47 |
| 2,485,428 | A. Bleier et al | 10/18/49 |
| 2,548,530 | M. Bick | 4/10/51 |
| 2,589,407 | J. Lee | 3/18/52 |
| 2,601,692 | C. O'Donnell | 7/1/52 |
| 3,128,494 | W. Hohmann | 4/14/64 |
| 3,160,909 | H. Nelkin | 12/15/64 |
| 3,893,773 | Ten Heuw | 7/8/75 |

Such prior art devices utilize an applicator roller as the drive roller and it has been found unsatisfactory because at certain viscosities of the coating material, such as paint, and excessive roller bearing friction against the surface being coated, the roller may not always start rotating on the surface. For example, it will often start skidding on the freshly coated surface resulting in an uneven coating and unsatisfactory finish.

To remedy the foregoing problem of the prior art, an additional outboard drive wheel and idler wheel with a positive traction band or a solid rubber wheel with high friction drive action is provided from a dry or uncoated surface so as to be used in offset relation during the application roller coating operation. The drive wheel is mounted to provide a manual quick-disconnect from the applicator roller, to thereby permit the applicator roller to continue the applicator roller rotation independently at this stage on the coating. Thus, at this stage, the applicator roller provides for the coating to be spread out laterally and worked into the surface free of the additional offset traction wheel to avoid any wheel marks on the finished surface. However, up to the final coating stage without the additional drive wheel in driving or surface traction engagement, the slippage of the applicator roller and feed roller will lack the continuous and even distribution of the coating material. This is particularly important when the application roller used has an ornamental pattern on its outside diameter.

SUMMARY OF THE INVENTION

Accordingly, an object of this invention is to provide a manual fountain surface coating or painting device of the surface applicator roller drive type provided with an additional offset outboard traction wheel drive coupled to the applicator roller shaft during surface coating but disconnectable from any surface contact when desired to avoid wheel marks on a coating finish whereby smoother and more even finished surface coating results.

Another object is to eliminate the possibility of the coating applicator roller blotting, smearing or skidding due to variable conditions, such as viscosity of the coating product or excessive thrust and pressure of the roller against the surface being coated.

Briefly, the useful novel aspects of this invention reside in the provision of an added additional drive and idler wheel with a positive traction band or tire or of a non-skid friction material that is employed during the coating application stage performed by the coating roller as it is moved over the surface. The additional traction wheel is offset so as to always roll along a dry part of the surface being coated by the applicator roller to maintain non-skid traction independently of any skidding tendency or the like of the coating applicator on the newly relatively wet coated surface, to thereby provide constant traction during the coating independently of the applicator roller. Also, when desired the additional traction roller may be disconnected or moved to a non-traction position while the applicator roller continues to rotate and coat independently.

BRIEF DESCRIPTION OF THE DRAWINGS

With the foregoing and other objects and advantages and other features which will now become apparent as the invention is fully understood, the same resides in the novelty of construction, combination and arrangement of parts hereinafter described in detail and distinctly claimed in conjunction with the accompanying drawings, wherein:

DESCRIPTION OF PREFERRED EMBODIMENTS

Figure 1:
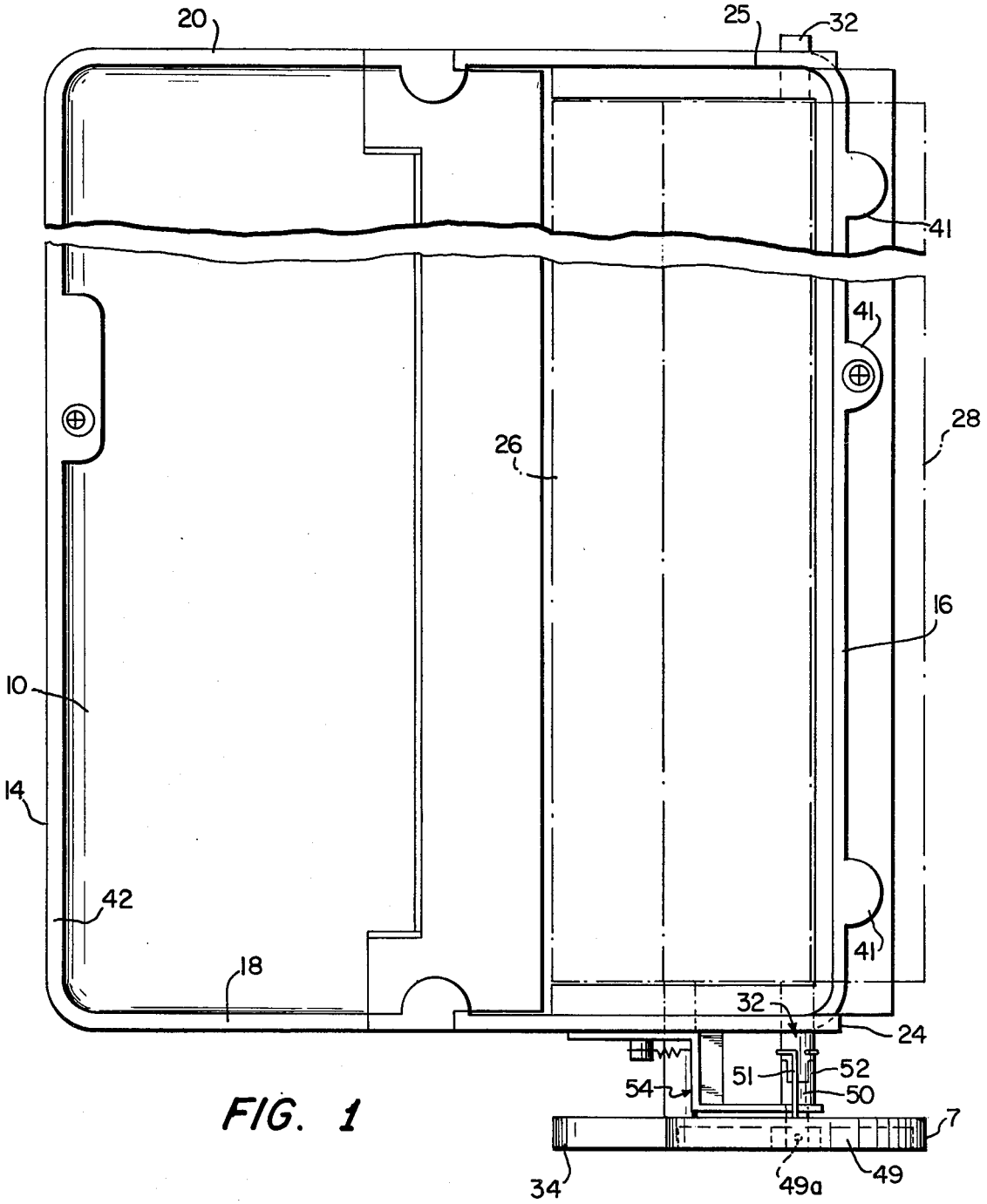
FIG. 1 is a top plan view of the assembled device of the present invention.
Figure 2:
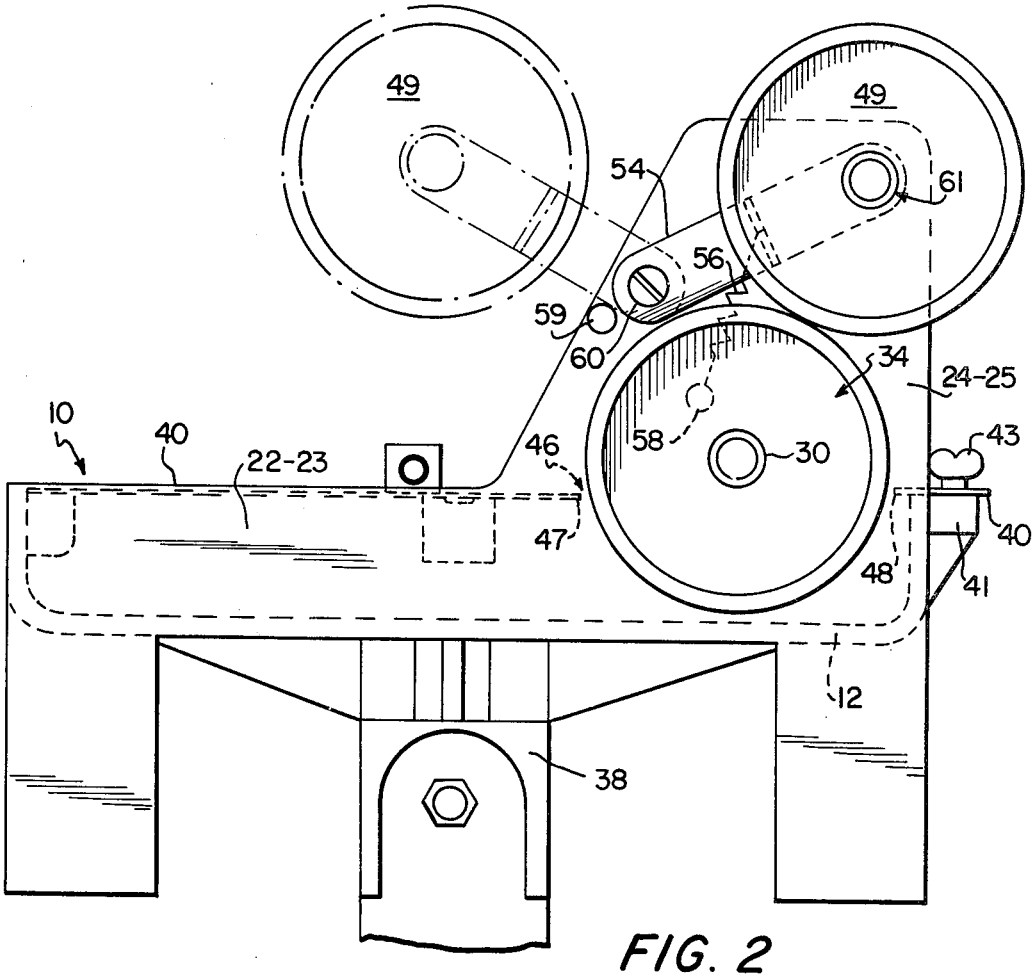
FIG. 2 is a side elevational view of one form of the invention showing one side of the paint tray with the novel drive means of the present invention mounted thereon.

Referring in detail to the drawings and first with specific reference to FIGS. 1 and 2 there are shown a top plan view and a side view of the assembled device. These views show a reservoir tray 10 open at the top which serves as the coating product reservoir including a bottom wall 12, end walls 14 and 16, see FIG. 1, and side walls 18 and 20.

The side walls 18 and 20 of the tray 10 in side elevation, see FIG. 2, are formed with front wing portions in the provision of relatively narrow rear side portions 22 and 23 continuing into the relatively wide semi-triangular wings 24 and 25. These wings facilitate the mounting of a fountain feeder roller 26 and an upper applicator roller 28 on shafts 30 and 32 within the tray 10. Each respective roller 26 and 28 may be mounted or suitably secured to their respective rotatable shafts 30 and 32 journalled in vertically spaced relation between the wing sections 24 and 25. The fountain feeder roller 26 dips into the coating material in the tray 10 and is engages with upper applicator roller 28 to feed coating material thereto. The applicator roller 28 in a preferred form is a conventional roller cage with a removable fabric cover. Roller 28 extends transversely across the tray interior in spaced relation above the fountain feeder roller 26 and its shaft 30. The shaft 32 in this embodiment includes the cage and two stub shafts at opposite ends thereof. The feeder roller is frictionally driven by the applicator roller 28 in addition to the drive provided by the idler roller so as to rotatably dip the fountain roller 26 into the coating product contained in the tray 10. Thus, feeder roller 26 applies the coating to the applicator roller 28 mounted on its shaft 32 above the roller 26, as generally known to the prior art.

A novel additional drive arrangement is mounted on the exterior of one of the wing sections 24, 25 of the side walls of the tray. The additional drive arrangement is comprised of an idler wheel 34 coupled to the exterior end of the feeder roller shaft 30 and a traction wheel 49 coupled to the end of shaft 32. Traction wheel 49 and idler wheel 34 are each provided on the exterior surfaces thereof with a coating such as rubber or other high friction material having anti-skid properties. When in the operative position, traction wheel 49 engages both the surface to be coated and idler wheel 34. Thus, when the paint tray is manually manipulated by the handle attached to the tray thereof, traction wheel 49 rolls across the surface to be painted and transfers its rotary motion to impart drive to the idler wheel 34. Since traction wheel 49 is rolling along a dry unpainted surface offset from the area of the applicator roller 28, a non-slip drive action is imparted to applicator roller shaft 32 and feeder roller shaft 30 via idler wheel 34.

The applicator roller 28 is in close frictional drive relation to the fountain feeder roller 26 so as to rotate the fountain feeder roller in the tray in conjunction with the idler wheel 34 to periodically cause it to dip into the fluent coating compound in the tray to be applied by the applicator roller 28 to the surface to be coated. This surface may be a wall or ceiling and when the tray is bodily moved by a suitable handle connected into the handle receiving socket 38 on the central exterior portion of the tray bottom, see FIG. 2, traction wheel 49 will rotate by frictional contact with the wall or ceiling assisting the rotation of the applicator roller on the surface being coated without slippage.

There is provided a cover 40 to inhibit spilling, leakage, or evaporation of coating material from the reservoir tray 10, when bodily moving the tray with the fountain feeder and applicator rollers. This cover is securely mounted on lugs 41 with threaded bores to receive cover fasteners such as 43 to hold the cover 40 in sealing relation upon rim or flange 42 formed around the rim of the tray 10. The cover is provided with an elongated slot 46 of a width to receive the fountain feeder roller 26 and permit its rotation inside the tray and it is provided with alignable openings, not shown, to register with the threaded bores of the flange lugs 41. Also, the spaced edges 47 and 48 which define the slot 46 serve as scrapers to regulate the coating thickness supplied to the fountain roller 26 with a resulting smooth uniform distribution of coating to the applicator roller 28 and the surface being coated.

The wing 24 of the tray side wall 18 is shown as the supporting wing or plate for a novel outboard additional traction roller drive arrangement for the fountain feed roller 26 and applicator roller 28 mounted on their respective shafts inside or inboard of the end walls 18 and 20 of the tray 10. This novel drive arrangement provides for a constant non-skid drive, as described hereinbefore as the additional traction wheel 49 of this drive arrangement is detachably coupled by stub shaft 50 of this wheel and the coupling clip 51 to the mating end of the projected end 52 of the applicator roller shaft 32, see FIGS. 4A–4C and 5. The wheel 49 has a detent 49*a* and snaps onto shaft 50 and a dog clutch in 50 engages in the detent. Also, mounted on the shaft 50 is a pivot support link 54.

Figure 3:
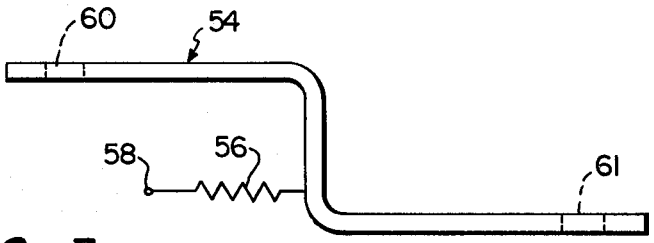
FIG. 3 is a detail of the additional drive wheel pivot support and quick disconnect link, as shown assembled in FIG. 1 with the off-center spring arrangement.

Referring to FIG. 3, this link 54 is somewhat S-shaped and is spring biased by the spring 56 attached to the mid part of the link at one end and the opposite end to a pin 59 projecting from the side wing 24. Each end of the link is formed with openings 60 and 61, one opening 60 being pivotally mounted on the additional traction wheel shaft 50 and the other end to an off-center link pivot pin 63 mounted on the wing 24, see FIGS. 2 and 5. When the clip 51 to be described hereinafter is released from coupling retaining position to the shaft end 52 of the applicator roller shaft 28 exteriorly projecting beyond the outboard side of the wing 24, the manual movement of the link 54 causes the spring 56 to snap the link over against a limit stop 59 mounted on the outer face of wing 24. This permits the link 54 to swing the additional traction wheel away from its functional contact with any driving connection, thereby permitting all drive power and surface coating to be performed solely by the applicator roller 28, see the dotted line disconnect position of the outboard traction wheel 49 as illustrated in FIG. 2.

Figures 4A, 4B, 4C:
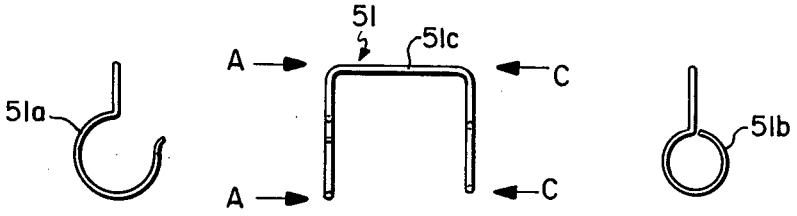
FIGS. 4A to 4C illustrate the spring clip of the quick disconnect link of the present invention.
Figure 5:
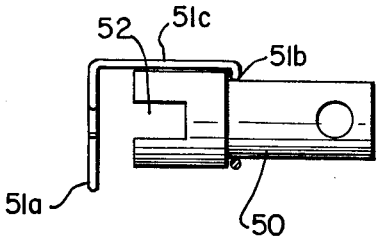
FIG. 5 shows the spring clip of FIGS. 4A–4C mounted on the traction wheel stub shaft of FIG. 1.
Figure 6:
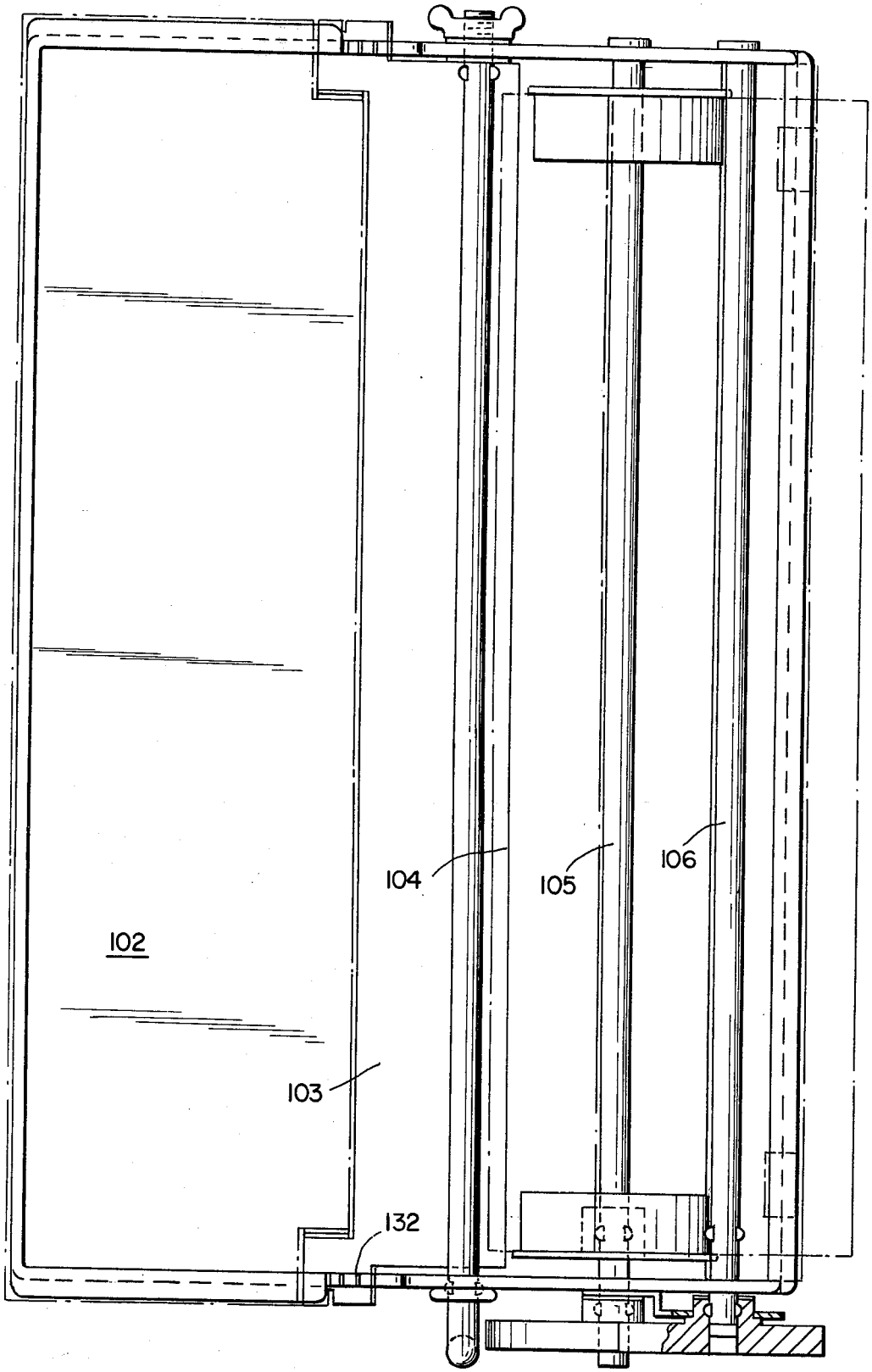
FIG. 6 is a top plan view of the assembled device of a second embodiment of the present invention.

The disconnect operation between shaft 32 and stub shaft 50 can be better understood by reference to FIGS. 4A–4C and FIG. 5. FIGS. 4A–4C illustrate, respectively, an end view of the clip portion 51*a* which snaps onto applicator drive shaft 32, a side elevational view showing the central connecting section 51*c* between the respective end sections, and an end view of spring clip portion 51*b* which is fitted around stub shaft 50 as indicated in FIG. 5. Referring in detail to FIGS. 1, 4A–4C, and 5 it can be seen that when it is desired to disconnect traction wheel 49 from applicator drive shaft 32 and pivot it about lever 54, that one merely needs to manually engage traction wheel 49 and pull it backwards away from shaft 32 about the pivot point 60 on link 54. Since end 51*b* of spring clip 51 is affixed to stub shaft 50 and end 51*a* merely snaps about shaft 32, as traction wheel 49 is pivoted backwardly spring clip portion 51*a* snaps off of shaft 50 to the dotted line position illustrated in FIG. 2.

Another embodiment of the present invention is illustrated in FIGS. 6–14 of the drawings. For example, with specific reference to the assembly views shown in FIGS. 6 and 7, the tray 100, of this embodiment has a snap-on cover 102, a front scraper 103, a rear scraper 104, and a tray connected handle 105*a*, all of which are modified and will be described specifically hereinafter. Also, the fountain feed roller 26 and the applicator roller 28 of the invention mounted in the tray are provided with different axle formations 105 and 106 respectively, see FIGS. 8 and 9. The rollers are provided with end hub caps 26*a* and 28*a* and key hole slots for the roller shafts to extend therethrough, see FIGS. 13 and 13*a*. These axles are each formed with their own respective stopheads 108 and 109 or suitable coupler lugs 108*a* and 109*a*, see FIGS. 8 and 9, at each end and with diametrically spaced keys or lugs 110 and 111 made to key couple in the base of each hub of each respective idler wheel 34 and the traction wheel 49 on the roller shaft for the fountain feed roller and the applicator roller and extend outside the tray side wall wing 124. These wheels 34 and 49 thus are mounted outboard, that is, externally on the side tray wall wing 124 and the respective wheel hubs are each provided with diametrically opposite key slots 114 and 115, see FIGS. 10 and 11.

The idler and additional traction wheels 34 and 49 may be mounted on the extended free ends of the roller shafts or axles 105 and 106 and couple to these shafts by the mounting of the wheel hub key slots in registry with the spaced key lugs 110 and 111 of the respective extended roller shaft ends adjacent tray side wall wing 124. These wheels, when manually turned slightly, become latched onto the extended free ends of the respective roller axles 105 and 106 of the feed roller 26 and the applicator roller 28.

Figure 10:
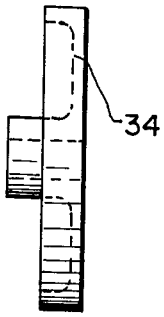
FIGS. 10 and 10*a* are side and front elevation views of the additional traction drive wheel.
Figure 10A:
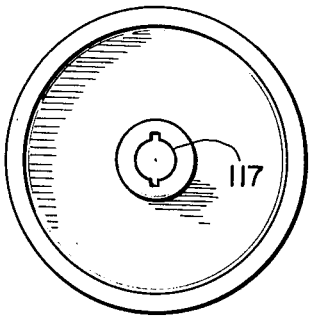
Figure 11:
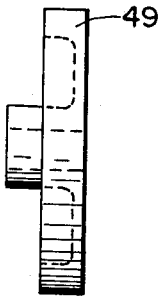
FIGS. 11 and 11*a* are side and front elevation views of the fountain feed idler wheel mounted on the exterior side of the tray wall and engaged with the additional traction wheel of FIGS. 10 and 10*a;*
Figure 11A:
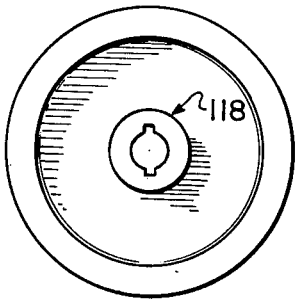

The idler wheel 34 and additional traction wheel 49 of this embodiment are basically the same as in the first embodiment but provide elimination of the coupler parts shown in FIGS. 4A through FIG. 5, and also the links 54 of the first embodiment is further modified to provide for the free key ends of the shaft axles of the roller shafts or axles 105 and 106, whereby direct couple with the fewer parts is provided in the key bore of each of the hubs 117 and 118 of outboard wheels 34 and 49 see FIGS. 10–11*a*.

Figure 12A:
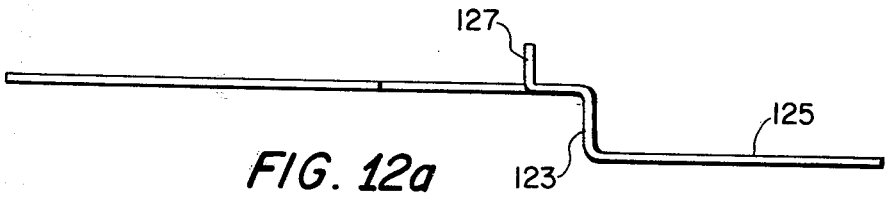
FIGS. 12 and 12*a* are details in side and front face views showing the spring steel pivot link formation of the second embodiment detached from the assembled views shown in FIGS. 6 and 7.
Figure 12:
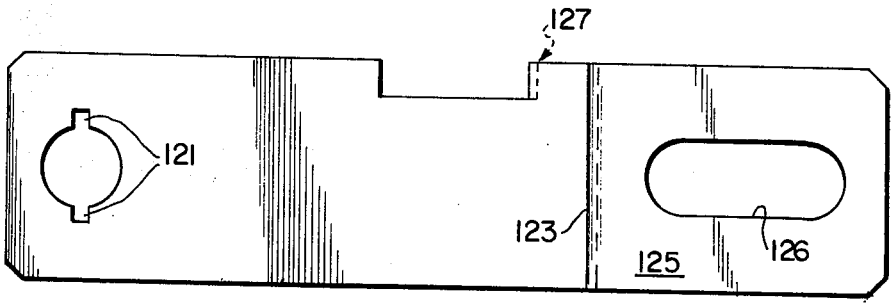
Figure 13:
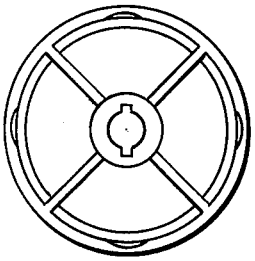
FIGS. 13 and 13*a* are representative of the roller end caps which frictionally engage in the ends of the fountain feed and applicator rollers mounted between the side walls in the reservoir tray.
Figure 13A:
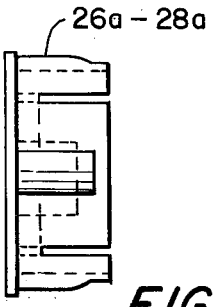

The link 54 of the first embodiment as it is now formed in this second embodiment is identified hereinafter as link 120, see FIGS. 7, 12 and 13. For example, modified link 120 couples at its lower end by key slots 121 over the key spaced key lugs 110 and 111 of end 105 of the fountain feed roller axle or shaft and is offset and continues upward from a bent shoulder section 123 into a flat head portion 125. This flat head is formed with an elongated opening or slot 125*a*, see FIG. 13, and receives and embraces the exterior of the hub 118 of the additional traction wheel 49 in the provision of lost motion action to provide for free pivot action to and from surface contact. The hub wheel 49 is internally key slotted to detachably couple to the free end of the applicator roller shaft 106, see FIG. 6, 7 and 11*a*.

As illustrated the link 120 is formed from a flat spring metal strip and along a part of one edge a part is cut-out and bent outward to provide a limit stop projection 127. This stop projection when the link 120 is manually pivoted, as shown in the dotted line position depicted in FIG. 7, engages with the top edge 130 of the side tray wall 124 and the traction wheel 49 may thus be positioned away from contact with any surface being coated or to be coated by the applicator roller 28.

Figure 17:
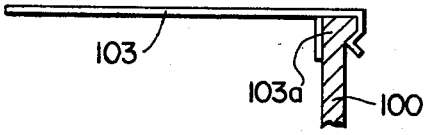
FIG. 17 is a partial side view of the front scraper and cover edge showing it snapped over the front rim of the tray reservoir front wall.
Figure 16A:
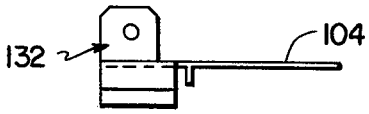

The side edges of the cover 102, and front and rear scrapers' side edges are each formed to be substantially even with the covers flanged top rim and side edges of the reservoir tray 100 and are formed with snap edges 102*a* engageable with the covers flanged rim. The exterior face of the side wall 124 provides for the mounting of the idler wheel 34, the additional traction wheel 49 and connecting link 120 in their proper coupled positions exterior of the side wall wing 124 of the tray 100 which makes up one of the side walls of the tray. Also, the tray 100 is strategically formed not only to mount the cover 102 on the rear portion but also is provided on the rear spaced side edges with a plurality of aligned spaced notches or slots 132, rearward of the tray side wall wing portions 123–124, see FIGS. 6 and 7. These notches provide for adjustment of the rear scraper 104 with respect to the exterior surface of the fountain feed roller 34. These notches cooperate with push-in fasteners 134 engageable selectively with the slots or notches 132 on each side of the tray to provide such rear scraper adjustment with respect to the fountain feed roller 34 and edge of the cover 102. A front scraper 103 with a snap-on tray rim catch 103*a* is mounted at the front of tray 100 and serves to further provide proper regulation of the fountain roller feed of coating material from the fountain feed roller 26 to the applicator roller 28, see FIGS. 6, 7 and 17.

Figure 15:
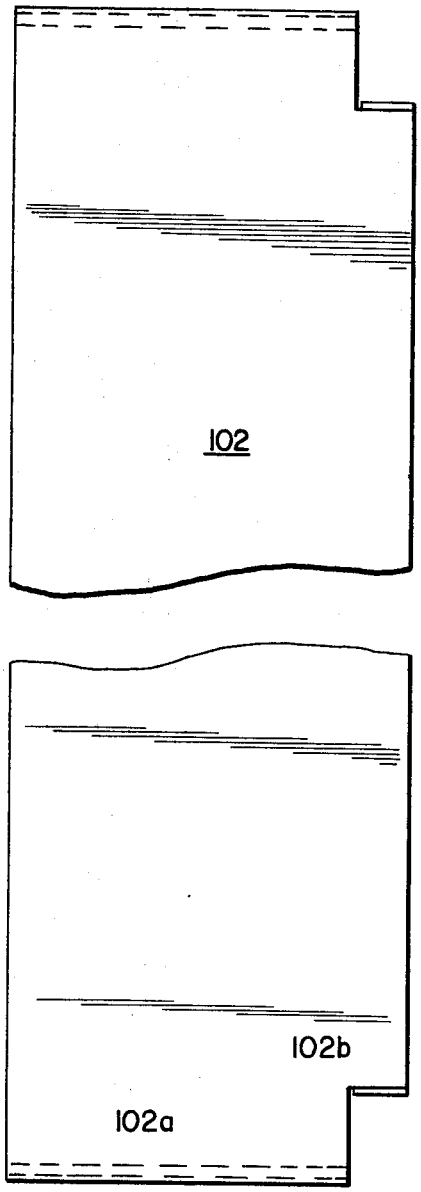
FIG. 15 is a top plan view of the reservoir tray cover showing the same removed from its snap-on position over the reservoir tray rim and the cut-outs at each side with the counter positions of the vertical upstanding perforated ears adjacent the rear scraper adjacent the fountain roller.
Figure 16:
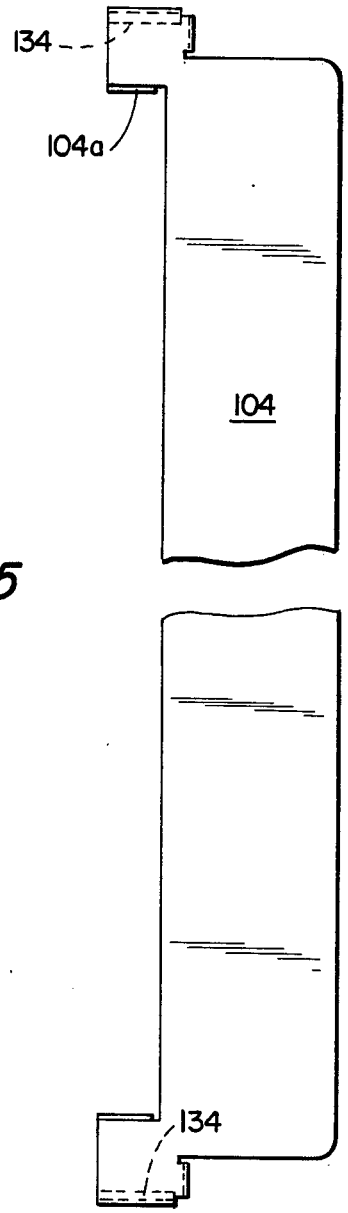
FIGS. 16 and 16*a* are views of the rear scraper showing its snap-on fastener edges and the vertical upstanding ears connectable with the complementary cover ears.

The rear and front scrapers 103 and 104 respectively are so positioned and shaped as to alignably fit in relation to the cover 102 and provide for easy separation individually for cleaning. The overlapping and alignable apertures in each of the upstanding tabs 102*b* and 104*a* of the cover and its rear scraper 104, are alignably connectable by any suitable connecting means, insertable in the apertures of the tabs to hold the cover and scraper assembled, whereby they may be separated and demounted for cleaning off any dried or encrusted material therefrom after each use, see FIGS. 15 and 16.

Tray Handle

Figure 7:
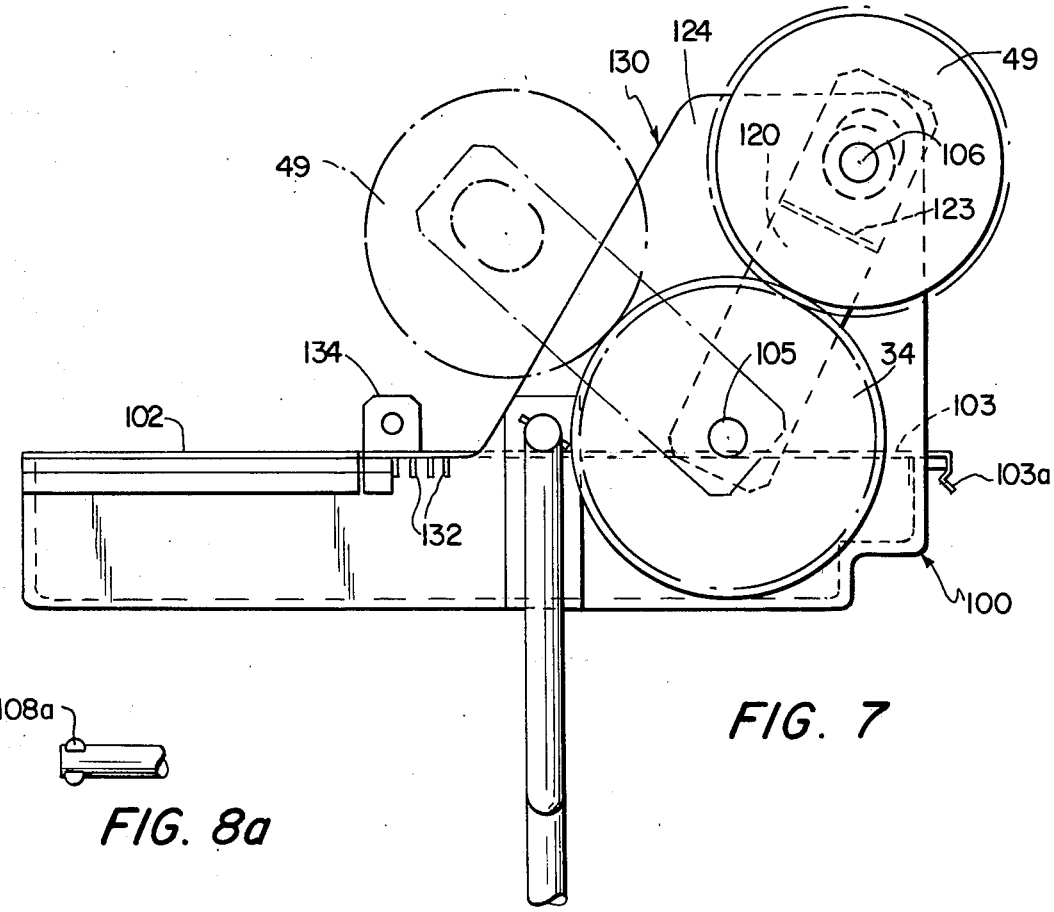
FIG. 7 is a side elevation view of the second embodiment specifically showing one side of the reservoir tray with the novel drive details of the second embodiment of the invention.
Figure 8A:
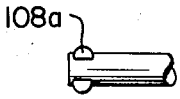
FIG. 8 is a side view of the roller shaft for mounting the surface coating applicator roller and an additional traction wheel and FIG. **8*a*** is an alternate form with respect to one mounting end of the shaft at an opposite side of the reservoir tray.
Figure 8:
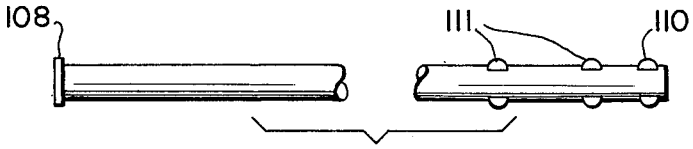
Figure 9A:
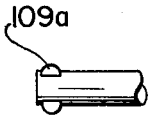
FIGS. 9 and **9*a* are similar views to FIGS. 8 and 8*a* showing roller shaft for mounting the fountain feed roller and wherein an extended end of the shaft exterior of the side tray wall is made to mount an idler wheel and the end of a novel link pivotally and connected by a lost motion connection to the hub of the additional traction wheel also exteriorly mounted adjacent the tray wall as shown assembled in FIGS. 6 and 7**.
Figure 9:
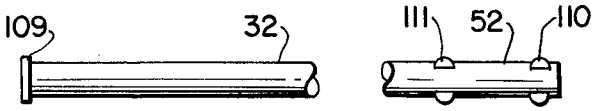
Figure 14:
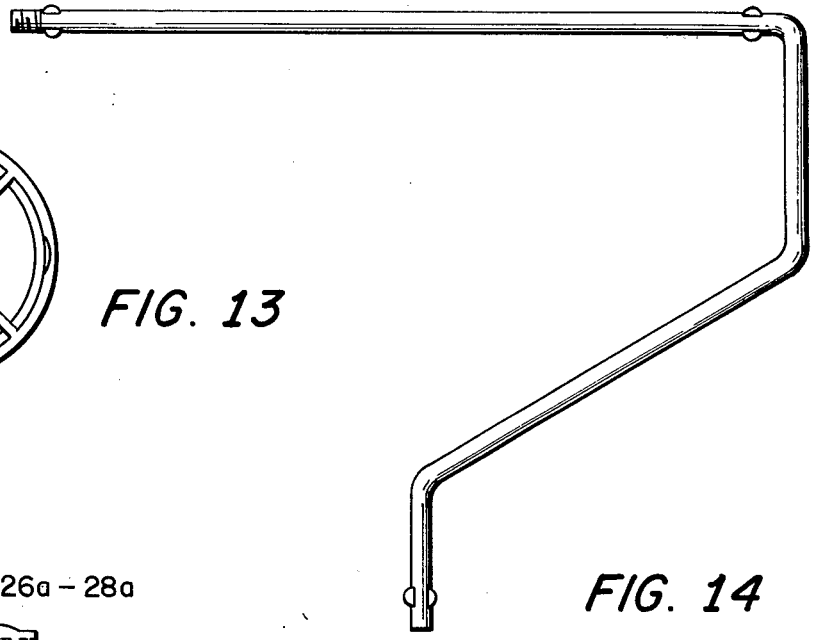
FIG. 14 is a detail of one form of handle usable with the second embodiment shown in assembly views depicted by FIGS. 6, 7.

The tray is further modified to provide a handle mount arrangement for a suitably shaped handle 136, see FIG. 7, and FIG. 14. The handle may be formed from one piece of steel rod on the side comprising a tray span section 137 with a threaded end 138 extended through a side wall of the tray from lug stops 139 inside or inboard of the wall. A washer 140 and a wing nut 141 are secured to the threaded end 138 and the other end of the handle is angularly offset and extends downwardly and depends exterior of the tray bottom from the span portion across the tray to receive any suitable form of handgrip, not shown, keyed to the free depending end of the rod.

Each embodiment illustrated herein is operated in a similar manner to provide for coating a surface, such as for example, it may be desired to paint. For example, any suitable handle arrangement may be effectively and efficiently attached to the reservoir tray and apply coating material to a surface when moved thereover, whereby the main rollers will properly function. That is, the fountain feed roller has imparted to it by the driving action of the coating applicator roller which applicator roller also imparts rotation to the additional traction wheel and in turn which imparts rotation to the idler wheel on the fountain feed roller shaft.

This manual action through the handle attached to the reservoir tray is continued during the travel courses of the device as it traverses any surface being coated and is continued with rotation of the additional drive wheel which also is in driving contact with the uncoated dry surface of the coated area or the area being coated by the applicator roller. However, when the surface being coated by the applicator roller becomes closely adjacent to a side wall or the like, then additional wheel 49 is manually swung on its pivot link 120 into a raised non-traction position from any surface contact and the applicator roller 28, then completes the coating process alone.

As hereinbefore explained this provides for a substantially complete smooth coating over the surface being treated or coated and eliminates any roller or wheel marks.

Figure 18:
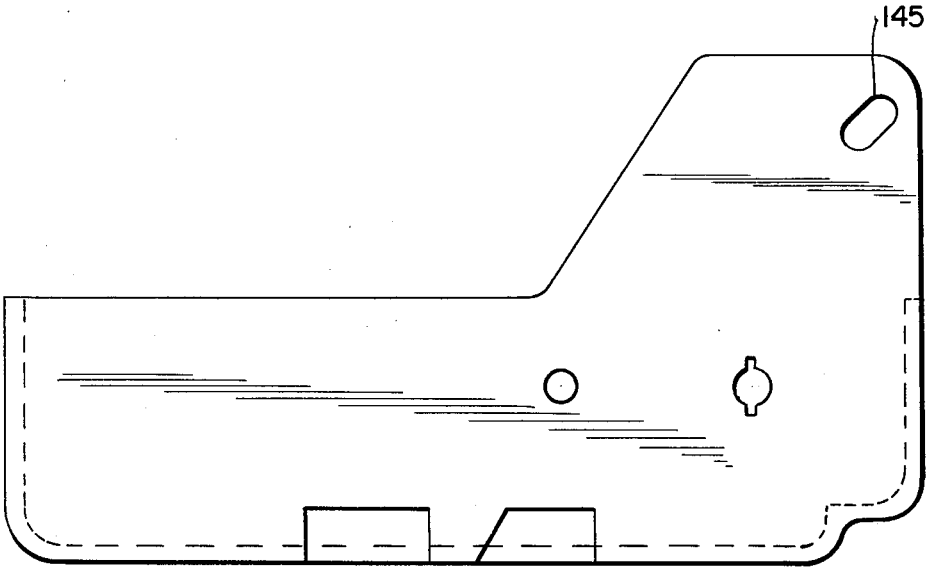
FIG. 18 is a side elevational view of a modified arrangement of the reservoir tray with the novel drive means of the present invention removed and the applicator roller shaft removed from the support holes, which are modified to provide a slot positioned to extend at a 45 degree angle.
Figure 19:
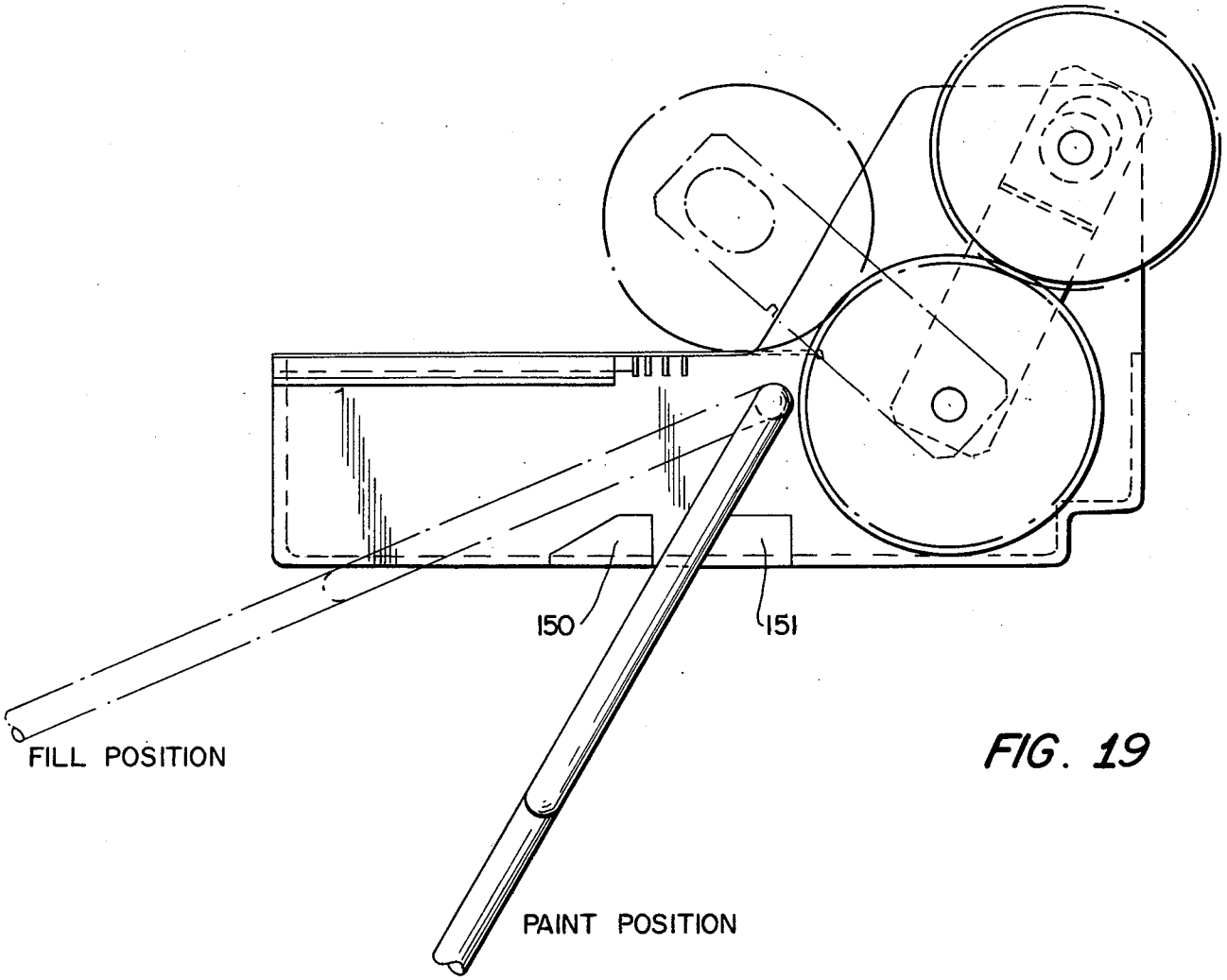
FIG. 19 is a side elevational view of the reservoir tray showing a modification of the tray side by the provision of exteriorly projected spaced handle locator lugs, identified by legends indicative of tray fill and paint positions.

Referring to FIGS. 18 and 19 there is shown a modification of the invention with respect to the side wall of the reservoir tray. For example, the applicator roller shaft holes are modified to provide an angular slot 145. This extends downwardly at approximately 45 degrees. This is done to accomodate different diameter short nap paint rollers found on the present market, since it was discovered that if these bearing shaft support holes are not slotted, some smaller diameter rollers will not touch and will not transfer paint from the fountain feed roller to the applicator roller. Thus, the significance of the 45 degree angle is that both the feed and applicator rollers are kept in contact regardless of whether the unit is pushed forward and back on the ceiling or up and down on the wall, during a painting operation.

Figure 20:
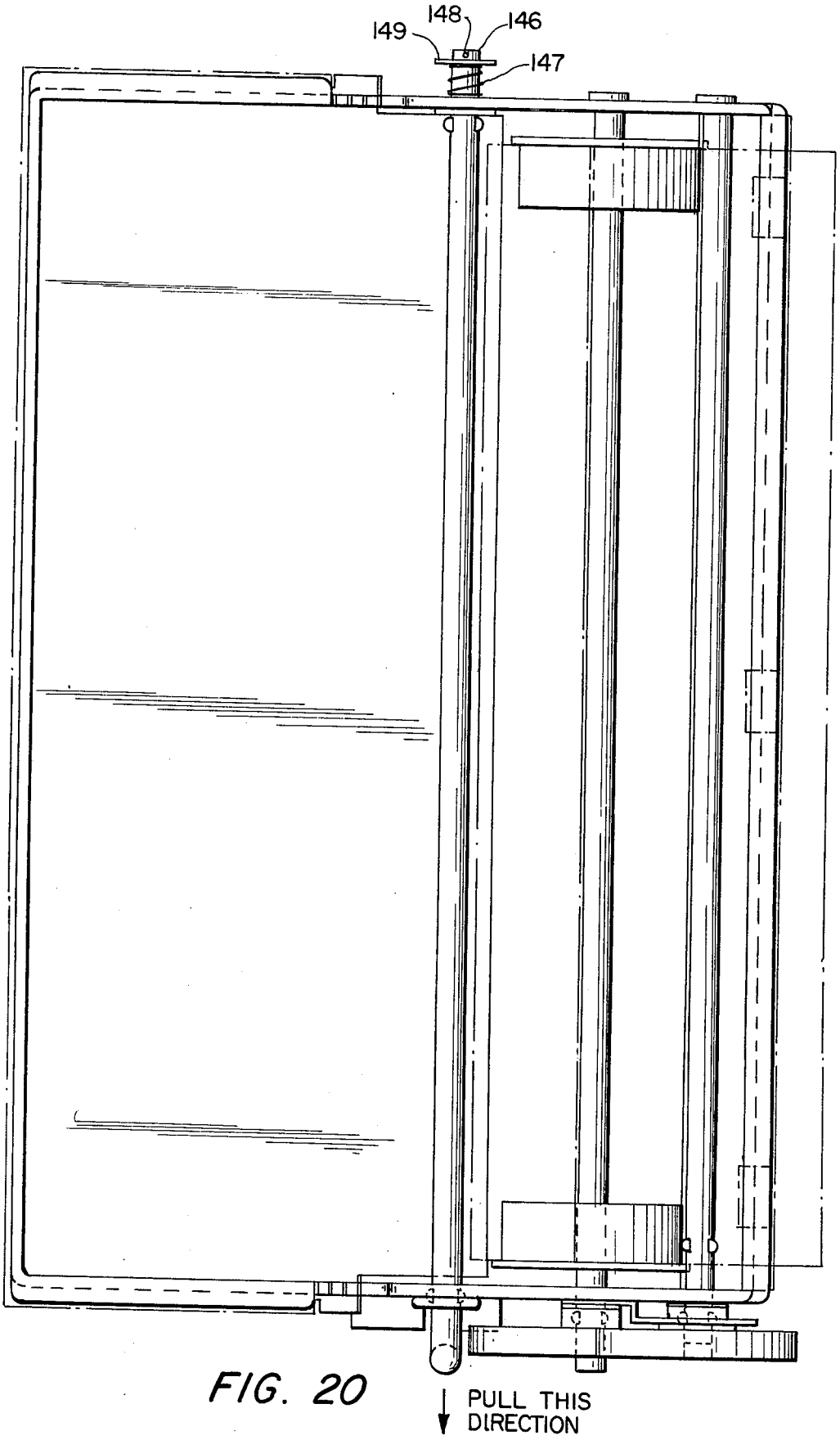
FIG. 20 is a top plan view of the reservoir tray to show the modified mounting arrangement of the tray handle for providing the respective fill and painting positions of the tray handle with respect to the tray wall mounted lugs.

The handle is mounted, as shown in FIG. 20, to permit the handle to be positioned from the paint position to an out-of the way position for refilling the tray. This is done by mounting a coil spring 147 on the free end of the handle and 146, extending to the exterior of one of the sidetray walls and secured by a cotter pin 148 and a retainer washer 149. The spring is compressible when the handle is manually pulled out sideways over one of the spaced lugs 150 and 151 carried by a lower side of the reservoir tray from the painting position of the unit to a tray paint filling position, see FIG. 20. Thus, by pulling the handle rod out and swinging it clockwise over lug 150 and letting it rest under the tray, it is in a very convenient position to permit the refill of the tray with paint. Then to resume the painting position, the handle is swung counter-clockwise over the lug 150 into the space between the lugs 150 and 151 before proceeding with painting.

What is claimed is:

1. A manually operated fountain feed coating device having a surface coating applicator roller and a fountain feeder roller in peripheral contact with the exterior surface of the coating applicator roller, said rollers each having a drive shaft, a reservoir for supplying a coating product to said fountain feeder, said reservoir having side, end and bottom portions, one side of said reservoir being provided with a projection, said shaft of each roller having bearing ends journalled to rotate in said side portions, said applicator roller being rotatable by its own traction on a surface to be coated when manually pressed against said surface and manually moved with said reservoir over the surface, a traction wheel journalled in at least one of said side portions outboard of said reservoir, and a link coupled at a first end to said traction wheel and to said reservoir at a second end, and off-center spring means connected at one end intermediate said link, the other end of said spring being connected to said projection, said link and spring facilitating the disconnection of said traction wheel from said applicator roller, said traction wheel being engageable with the dry uncoated surface at the side of a fresh wet coated area of the surface being traversed and coated by said applicator roller, said traction wheel being coupled to the drive shaft of said applicator roller to impart rotation thereto;

said traction wheel being in driving contact with an idler wheel keyed to the shaft end of said fountain feeder roller drive shaft;

said traction wheel being provided with a quick disconnect means for disengaging said traction wheel from said applicator roller drive shaft and for disconnecting said traction wheel from said idler wheel to thereby permit said applicator roller to be rotated independently from said traction wheel.

2. A manually operated fountain feed coating device as described in claim 1, where the said side and end portions of the said reservoir are formed with a rim formed with fastener lugs, and a cover formed with a mating slot for said fountain feed roller, said cover serving to provide a seal for the contents of said reservoir when secured to said lugs.

3. A manually operated fountain feed coating device as described in claim 2, wherein the slot of said cover is defined by edge means to provide spaced scraper means for the fountain feed roller surface.

4. A manually operated fountain feed coating device as described in claim 1, wherein said reservoir is a tray and the exterior bottom of said tray is formed centrally with a socket to receive a suitable handle adjustable in said socket to provide for manual manipulation of the fountain feed coating device over a surface to be coated.

5. A manually operated fountain feed coating device having a surface coating applicator roller and a fountain feeder roller in peripheral contact with the exterior surface of the coating applicator roller, said rollers each having a drive shaft, a reservoir for supplying a coating product to said fountain feeder, said reservoir having side, end and bottom portions, said shaft of each roller having bearing ends journalled to rotate in said side portions, said applicator roller being rotatable by its own traction on a surface to be coated when manually pressed against said surface and manually moved with said reservoir over the surface, and a traction wheel journalled in at least one of said side portions outboard of said reservoir, said traction wheel being engageable with the dry uncoated surface at the side of a fresh wet coated area of the surface being traversed and coated by said applicator roller, said traction wheel being coupled to the drive shaft of said applicator roller to impart rotation thereto, said traction wheel being in driving contact with an idler wheel keyed to the shaft end of said fountain feeder roller drive shaft;

said traction wheel being provided with a quick disconnect means for disengaging said traction wheel from said applicator roller drive shaft and for disconnecting said traction wheel from said idler wheel to thereby permit said applicator roller to be rotated independently from said traction wheel;

said quick disconnect means including a stub shaft with a coupler end for mounting said traction wheel;

said application roller drive shaft being formed with a mating coupler part engageable with said stub shaft coupler end; and a detachable retainer clip being provided for holding said coupler part of said application roller shaft and said stub shaft coupler end together in coupled drive relation with each other, and a spring biased pivotal link connection being pivotally connected at one end to said traction wheel stub shaft at the other end to a pivot pin on one of said side portions of said reservoir.

6. A manually operated fountain feed coating device as described in claim 5, wherein said stub shaft supports an end of said spring biased pivotal link, to thereby allow said additional traction wheel to swing by off-center spring action from traction engagement with a surface to idle position out of surface engagement when said coupler end of said stub shaft is manually disconnected from said roller shaft.

7. A manually operated fountain feed coating device having a surface coating applicator roller and a fountain feeder roller in peripheral contact with the exterior surface of the coating applicator roller, said rollers each having a drive shaft, a reservoir for supplying a coating product to said fountain feeder, said reservoir having side, end and bottom portions, said shaft of each roller having bearing ends journalled to rotate in said side portions, said applicator roller being rotatable by its own traction on a surface to be coated when manually pressed against said surface and manually moved with said reservoir over the surface, and a traction wheel journalled in at least one of said side portions outboard of said reservoir, said traction wheel being engageable with the dry uncoated surface at the side of a fresh wet coated area of the surface being traversed and coated by said applicator roller, said traction wheel being coupled to the drive shaft of said applicator roller to impart rotation thereto, said traction wheel being in driving contact with an idler wheel keyed to the shaft end of said fountain feeder roller drive shaft;

said traction wheel being provided with a quick disconnect means for disengaging said traction wheel from said applicator roller drive shaft and for disconnecting said traction wheel from said idler wheel to thereby permit said applicator roller to be rotated independently from said traction wheel;

said quick disconnect means including;

a hub with a key slotted bore, said applicator roller drive shaft having an end with key lugs extending through a wall of said reservoir and into the said hub to thereby couple said traction wheel to the applicator roller drive shaft outboard of the reservoir wall; and a link formed with an elongated opening formed in an end portion of said link slidably embracing the exterior of said traction wheel hub, an opposite end portion of said link being pivoted to a projecting end of said fountain feed roller shaft outboard of said reservoir wall;

said link being manually pivoted to swing said traction wheel and its hub away from contact with any surface being or to be coated by said applicator roller.

8. A manually operated fountain feed coating device as described in claim 7, wherein said link and the elongated opening therein provide lost motion action to provide for freedom in the pivot action of said link to and from surface contact by the said traction wheel.

9. A manually operated fountain feed coating device as described in claim 8, wherein said link is formed of a strip of yieldable spring metal pivoted on the projected end of the fountain feed roller shaft.

10. A manually operated fountain feed coating device as described in claim 8, wherein said link includes limit stop means for restraining the motion of said link at a rest position when pivoted away from the said surface contact position of the said traction wheel.

11. A manually operated fountain feed coating device as described in claim 8, wherein said traction wheel and said idler wheel are each demountable to thereby allow removal of said wheels from connection with the respective drive shafts of the applicator roller and fountain feed roller of the coating device.

* * * * *